US007374153B2

(12) United States Patent
Huang

(10) Patent No.: US 7,374,153 B2
(45) Date of Patent: May 20, 2008

(54) DUAL BRAKING DEVICE FOR A POWER WINCH

(76) Inventor: Shih Jyi Huang, No. 19, Alley 6, Lane 325, Chien Kang Road, Taipei (TW)

( * ) Notice: Subject to any disclaimer, the term of this patent is extended or adjusted under 35 U.S.C. 154(b) by 0 days.

(21) Appl. No.: 11/519,888

(22) Filed: Sep. 13, 2006

(65) Prior Publication Data

US 2008/0078981 A1 Apr. 3, 2008

(51) Int. Cl.
*B66D 5/02* (2006.01)
*B66D 1/50* (2006.01)

(52) U.S. Cl. ..... 254/375; 254/267; 254/275; 254/356

(58) Field of Classification Search ..... 254/267, 254/268, 270, 275, 350, 356, 362, 368
See application file for complete search history.

(56) References Cited

U.S. PATENT DOCUMENTS 3,732,447 A * 5/1973 Perhats ..... 310/76
4,030,583 A * 6/1977 Miller ..... 192/84.1
4,228,874 A * 10/1980 Brinkmann et al. ..... 188/72.1
4,258,836 A * 3/1981 Miller ..... 192/84.81
4,292,557 A * 9/1981 Kishi ..... 310/78
4,397,380 A * 8/1983 Yew ..... 192/84.51
4,545,567 A * 10/1985 Telford et al. ..... 254/344
6,520,486 B2 * 2/2003 Huang ..... 254/347
7,002,310 B2 * 2/2006 Cavarec et al. ..... 318/375
7,185,881 B2 * 3/2007 Drarvik et al. ..... 254/267
2004/0262090 A1 * 12/2004 Miyoshi et al. ..... 187/289

* cited by examiner

*Primary Examiner*—Evan H Langdon
(74) *Attorney, Agent, or Firm*—Bacon & Thomas, PLLC

(57) ABSTRACT

A dual braking device for a power winch includes a first braking device and a second braking device, which is composed of a transmitting sleeve, a braking lining, an electromagnetic induction coil, a magnetic conduction member, and an elastic member. When the power winch is electrically connected for retracting or releasing steel ropes, the induction coil will produce magnetic force to attract the magnetic conductive member to move and compress the elastic member, and the braking lining cannot perform braking. When the power winch is electrically disconnected, the electromagnetic induction coil cannot produce magnetic force, and the magnetic conduction member will be actuated by the elastic member to contact with and force the braking lining to stop the rotating shaft and the spindle.

1 Claim, 5 Drawing Sheets

DUAL BRAKING DEVICE FOR A POWER WINCH

BACKGROUND OF THE INVENTION

1. Field of the Invention

This invention relates to a dual braking device for a power winch, particularly to one able to quickly stop both the rotating shaft of a motor and the spindle driven by the rotating shaft when the power winch is electrically disconnected to avoid wear of the spindle and the transmitted components, able to surely brake the whole power winch and lower the probability of accidents.

2. Description of the Prior Art

A power winch, also called as a hoisting winder, is a hoisting apparatus able to retract or release steel ropes for slinging up or lowering down heavy loads. A power winch can be positioned on a high building for slinging or lowering goods, or assembled on a jeep or on a cross-country vehicle for trailing other vehicles or for rescuing people in danger. A power winch has to be provided with a braking device so that when circuit is broken (whether by pressing a stop button or due to abrupt power outage), the power winch can be timely stopped operating. A conventional braking device for a power winch, as disclosed in a U.S. Pat. No. 6,520,486, titled "BRAKING DEVICE FOR MOTIVE WINCH", which was a patent of the inventor of the present invention, as shown in FIG. 1, includes a reduction device 1 composed of a sectional shaft 11, an elastic member 12, a first engraved block 13, a second engraved block 14 and a clutch base 15. The first engraved block 13 is fitted on the sectional shaft 11 and secured thereon with a braking lining 131 able to contact with or separate from a frictional surface 16 formed in the reduction device 1 for performing braking or not. The elastic member 12 is assembled on the first engraved block 13, able to produce a proper reverse torsional force relative to the first engraved block 13 and force the braking lining 131 of the first engraved block 13 to be ready to push against the frictional surface 16 of the reduction device 1. The second engraved block 14 is combined with the sectional shaft 11 for rotating together synchronously. The first and the second engraved block 13, 14 have their corresponding side edges respectively formed with a slope (13A), (14A), which are able to closely contact with each other for pushing the braking lining 131 on the first engraved block 13 to carry out braking, and also respectively formed with an actuating projection (13B), (14B) to be pushed and rotated by the projecting block fixed on the inner side of the clutch base 15. The clutch base 15 is actuated to rotate by a spindle (S1) driven by the motor. Thus, when the motor is operated, the clutch base 15 will be driven to actuate the two engraved blocks 13, 14 to rotate together to let the braking lining 131 move away from the frictional surface 16 of the reduction device 1 to stop braking. When the motor stops operating, the reaction torsional force coming from the heavy loads hung on the steep rope will force the slope (14A) of the second engraved block 14 to push the slope (13A) of the first engraved block 13 and actuated the braking lining 131 to move and closely contact with the frictional surface 16 of the reduction device 1, thus achieving effect of braking. The foresaid structure is the main braking device for a conventional power winch.

Although the braking device for a power winch disclosed in the U.S. Pat. No. 6,520,486 and described above is excellent in use, yet there is still certain respect that has to be improved. As mentioned above, the spindle (S1) is driven by the motor; therefore, when the motor is electrically disconnected, the motor itself, based on inertia action, will rotate the spindle (S1) continuously for a little while. Thus, when the power winch carrying a light load is broken, the gliding distance of braking may become comparatively long, and this situation is likely to cause unexpected accidents. In the braking device for a winch disclosed in the U.S. Pat. No. 6,520,486 mentioned above, although braking is surely done by the reduction device 1, yet the spindle (S1) and the cultch base 15 still may be pushed to rotate by inertia action, thus causing wear to the components and lowering their service life.

To improve the above-mentioned defects, an auxiliary second braking device for a power winch is additionally disposed between the motor and the spindle so that when the motor is electrically disconnected, both the rotating shaft of the motor and the spindle can be timely stopped rotating, able to lower the probability of accidents.

SUMMARY OF THE INVENTION

The objective of the invention is to offer a dual braking device for a power winch, able to quickly stop both the rotating shaft of a motor and a spindle driven by the rotating shaft when the power winch is electrically disconnected, avoiding wear to the spindle and the follow-up components, achieving excellent effect of braking and lowering the probability of accidents.

The dual braking device for a power winch includes a first braking device connected with a reduction device for carrying out principal braking and a second braking device at a force output portion of the rotating shaft of a motor for quickly stopping the rotating shaft without inertial rotation. The rotating shaft of the motor is inserted through a motor holder, which is fixedly combined with a combining base positioned at the outer side of a rope drum holder. Then, the rotating shaft of the motor has its outer end mounted with a transmitting sleeve fitted thereon with a braking lining to be received in the interior of the motor holder. An electromagnetic induction coil is installed in combining base, and a magnetic conduction member is positioned between the braking lining and the electromagnetic induction coil to be pushed by an elastic member disposed in the combining base. The magnetic conduction member can be pushed by the elastic member to move outward and contact with the braking lining or attracted by the electromagnetic induction coil to move away from the braking lining. The rotating shaft of the motor has its outer end firmly connected with a spindle inserted in the reduction device to actuate follow-up components to operate. When the power winch makes electrical connection for retracting or releasing the steel rope, the electromagnetic induction coil will produce magnetic force to attract the magnetic conduction member to move inward and compress the elastic member and then, there will form a gap between the braking lining and the magnetic conduction member as well as the motor holder. Thus, even though the braking lining is rotated together with the rotating shaft of the motor and with the transmitting sleeve, the braking lining cannot function to perform braking. When the power winch is electrically disconnected, the electromagnetic induction coil will be unable to produce magnetic force, and the magnetic conduction member will be actuated by the recovering elastic force of the elastic member to move away from the electromagnetic induction coil and contact with braking lining, thus leaving no gap between the braking lining and the magnetic conduction member as well as the motor holder. Therefore, the braking lining can quickly stop both the rotating shaft of the motor and the spindle.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
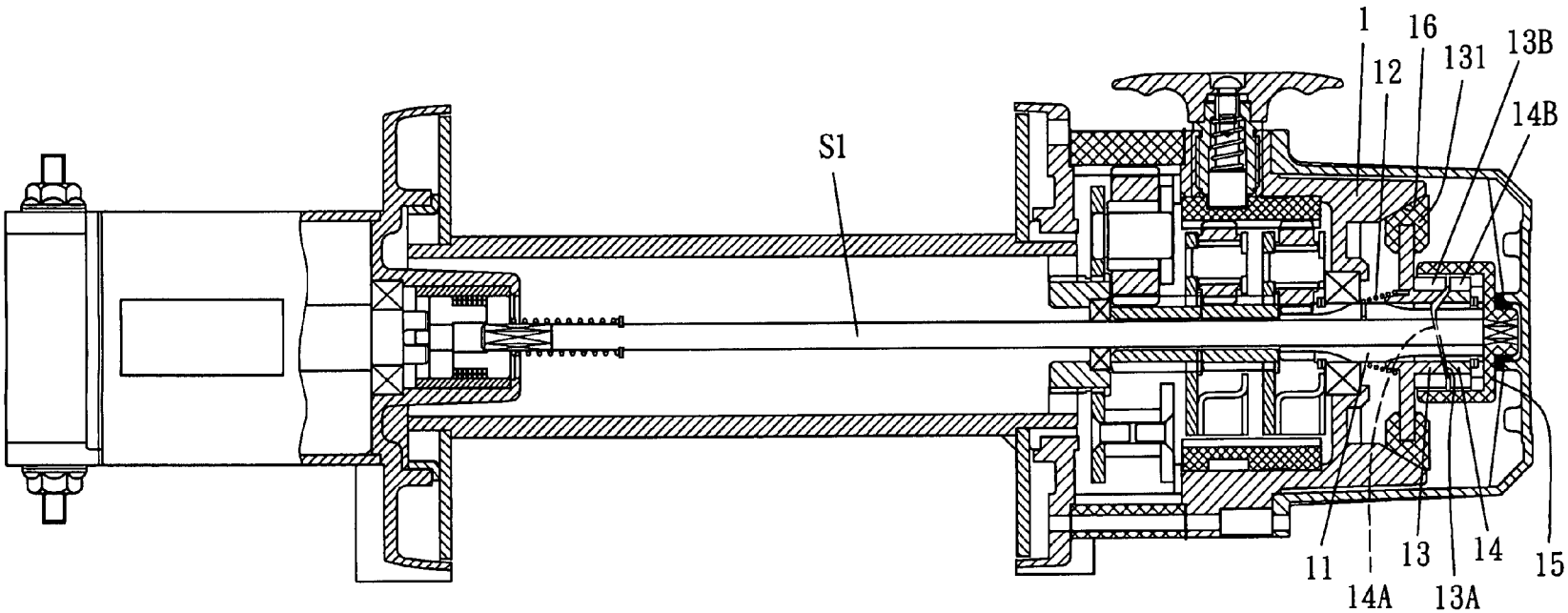
FIG. 1 (PRIOR ART)
FIG. 1 is a side cross-sectional view of a conventional power winch.
Figure 2:
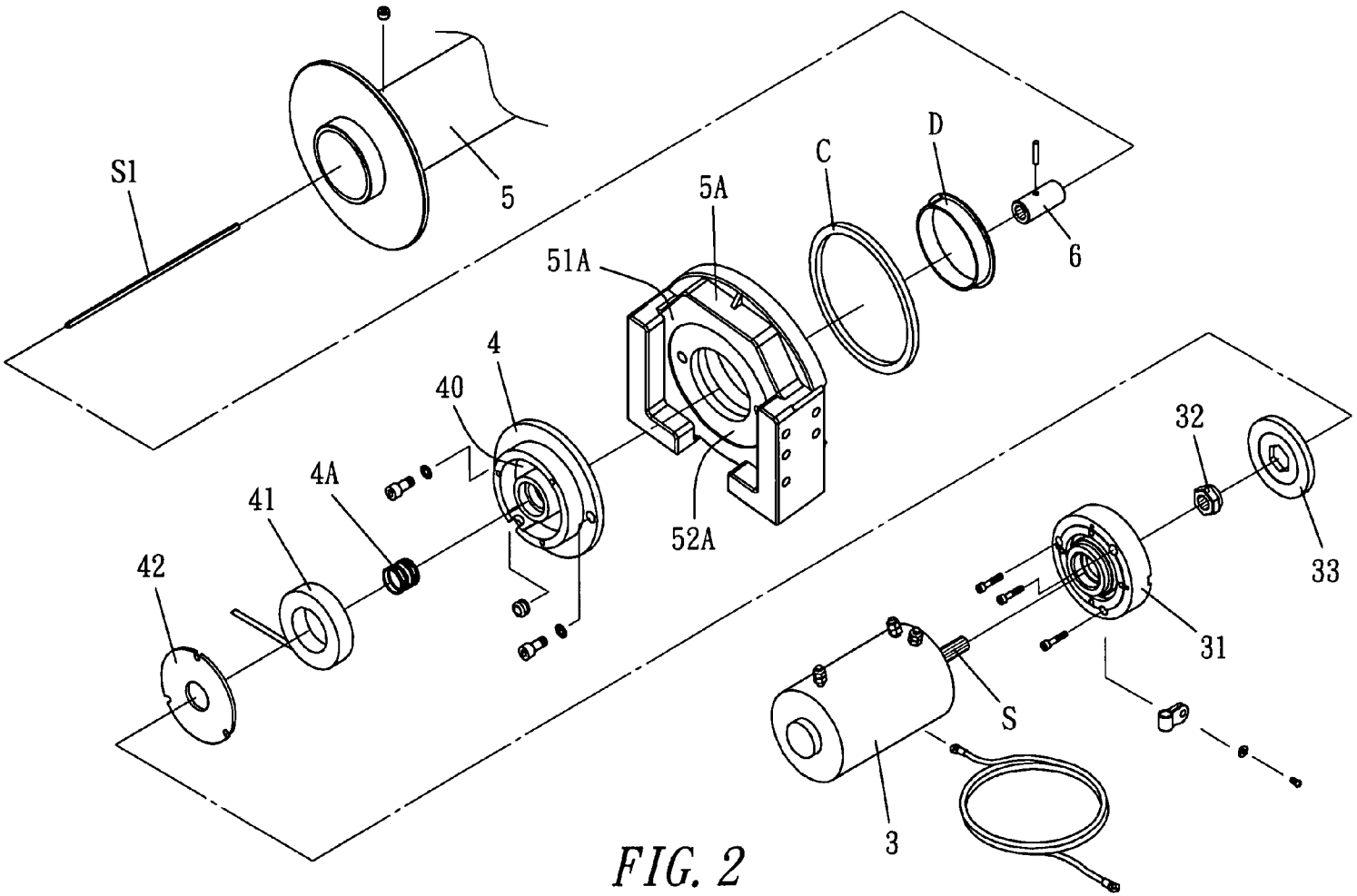
FIG. 2 is an exploded perspective view of a dual braking device for a power winch in the present invention.
Figure 3:
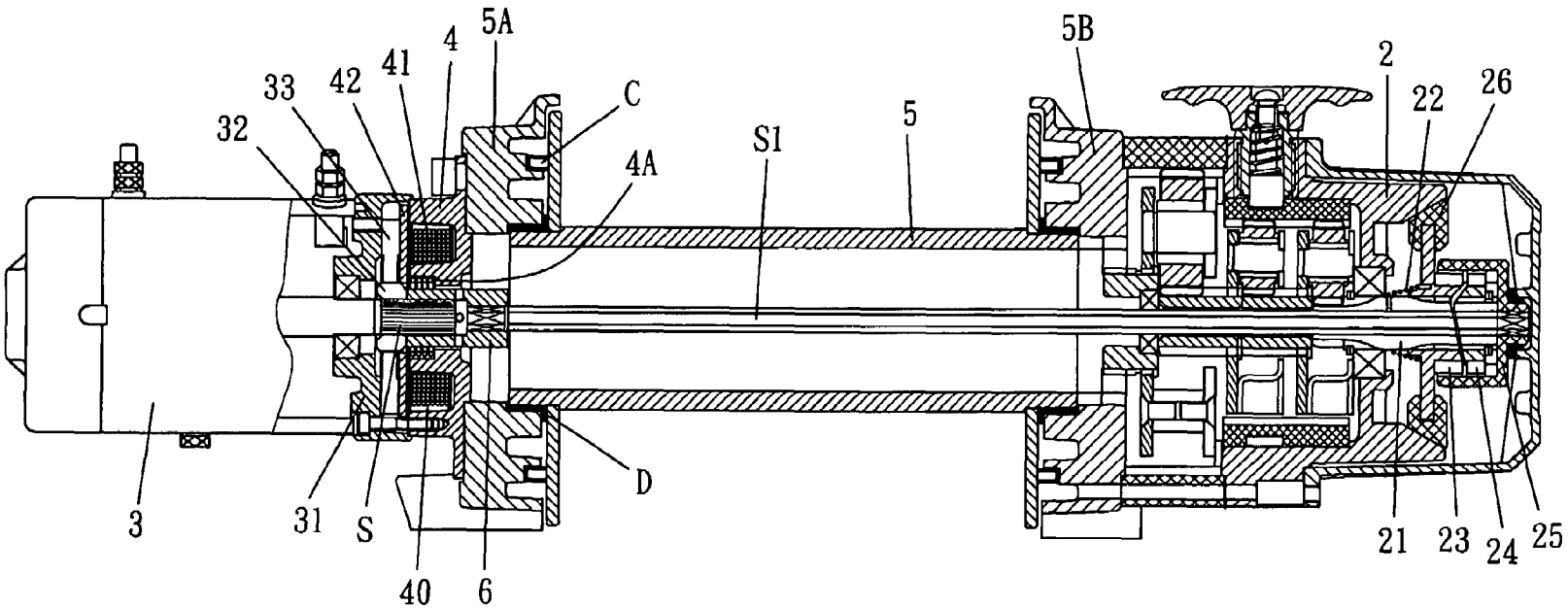
FIG. 3 is a side cross-sectional view of the dual braking device for a power winch in the present invention.

A preferred embodiment of a dual braking device for a winch in the present invention, as shown in FIGS. 2 and 3, includes a first braking device, a second braking device, a reduction device 2, a motor 3, a combining base 4, a rope drum 5 and a connecting sleeve 6 as main components combined together.

The first braking device has the same structure as the conventional braking device for a power winch described above, positioned in the reduction device 2 fixed at one side of the power winch and having its interior disposed with a reduction gear set and the first braking device. The reduction device 2 is bored with a lengthwise insert hole in the center for a spindle (S1) to be inserted therein, and the first braking device is composed of a sectional shaft 21, an elastic member 22, a first engraved block 23, a second engraved block 24, a clutch base 25 and a braking lining 26. The operating condition and the function of the first braking device of this preferred embodiment are the same as those of the conventional braking device described previously.

The motor 3 is firmly combined with a motor holder 31, having its rotating shaft (S) inserted through one side of the motor holder 31 and mounted thereon with a transmitting sleeve 32 having a braking lining 33 fitted thereon to let the transmitting sleeve 32 and the braking lining 33 driven to rotate and stop rotating together with the rotating shaft (S) of the motor 3 synchronously.

The combining base 4 is bored with a round hole in the center for receiving an elastic member (4A), and an annular accommodating groove 40 for receiving an electromagnetic induction coil 41 and for positioning a magnetic conduction member 42, which is positioned abutting the induction coil 41 and the braking lining 33.

Two rope drum holders (5A), (5B) are respectively positioned at the opposite sides of the rope drum 5 and fitted with the rope drum 5 by a bushing (D), letting the rope drum 5 able to rotate freely. The rope drum holder (5A) has its outer side formed with an accommodating groove (51A) having its bottom wall bored with a recessed hollow (52A) with a diameter equivalent to that of the combining base 4 for receiving and fixing the combining base 4 therein. A dust-prevention ring (C) is provided between each of the rope drum holders (5A) and (5B) and the rope drum 5.

The connecting sleeve 6 has one inner end formed with a serrated insert groove and the other inner end formed with a polygonal insert groove respectively for connecting the rotating shaft (S) of the motor 3 and the spindle (S1).

The transmitting sleeve 32, the braking lining 33, the induction coil 41, the magnetic conduction member 42 and the elastic member (4A) together make up the second braking device for a power winch in the present invention. The second braking device is mainly employed for quickly stopping both the rotating shaft (S) of the motor 3 and the spindle (S1) driven by the rotating shaft (S) without little inertia rotation when the power winch is electrically disconnected to prevent the spindle (S1) from inertially actuating its follow-up components to rotate.

Figure 4:
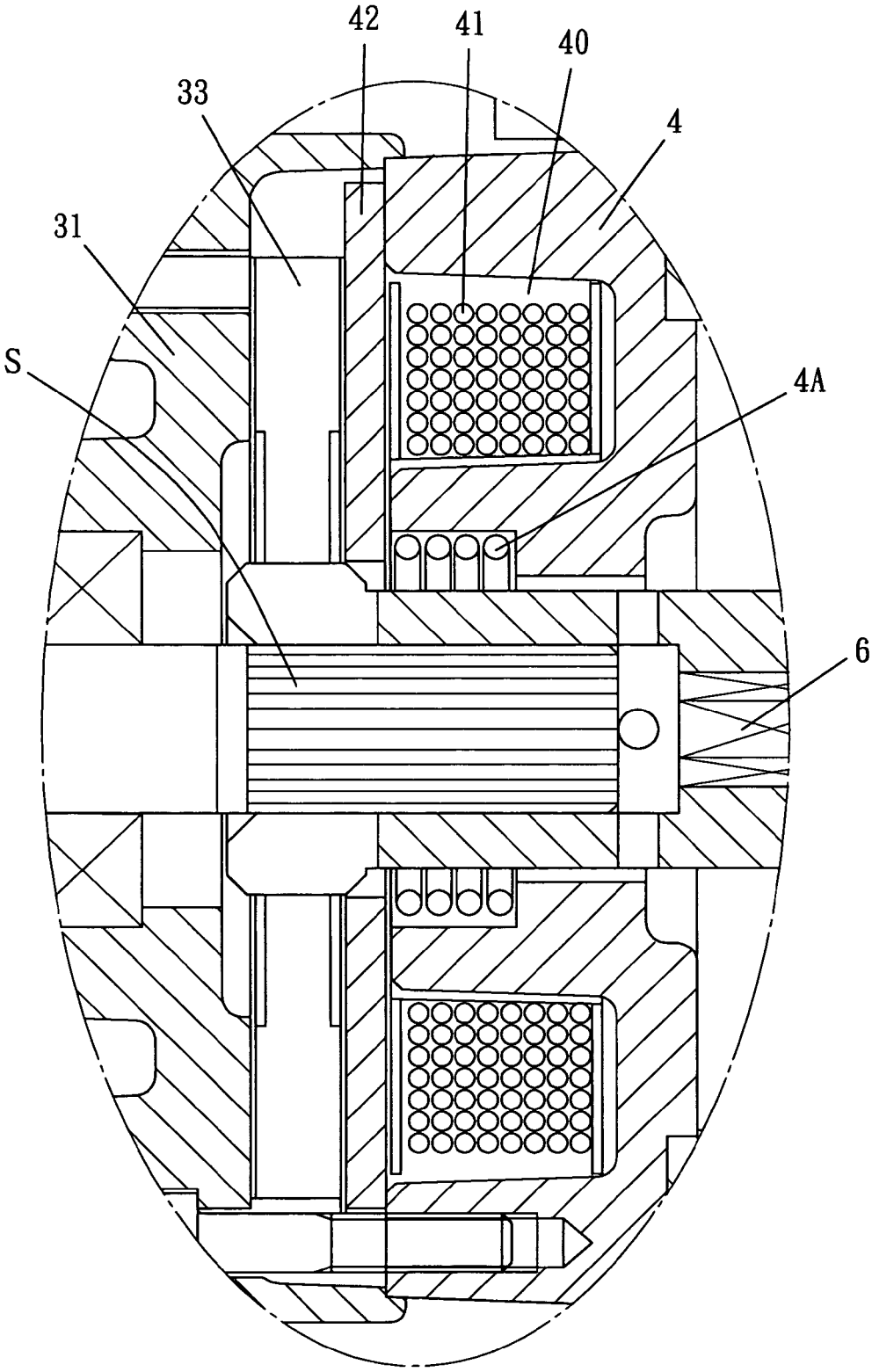
FIG. 4 is a partial magnified cross-sectional view of an induction coil producing magnetic force (disabling a braking lining to perform braking) in the present invention.

Referring to FIG. 4, when the power winch is electrically connected, the motor 3 will begin to operate for retracting or releasing the steel rope, and simultaneously the induction coil 41 will produce magnetic force to attract and move the magnetic conduction member 42 toward the combining base 4. At this time, the elastic member (4A) is pushed and compressed by the magnetic conduction member 42, and there will form a gap between the braking lining 33 and the magnetic conduction member 42 as well as the motor holder 31; therefore, even though rotated together with the rotating shaft (S) of the motor 3, the braking lining 33 cannot function to carry out braking. Thus, the power of the motor 3 can totally be transmitted to the rope drum 5 for hoisting (or retracting) or lowering (or releasing) the steel rope.

Figure 5:
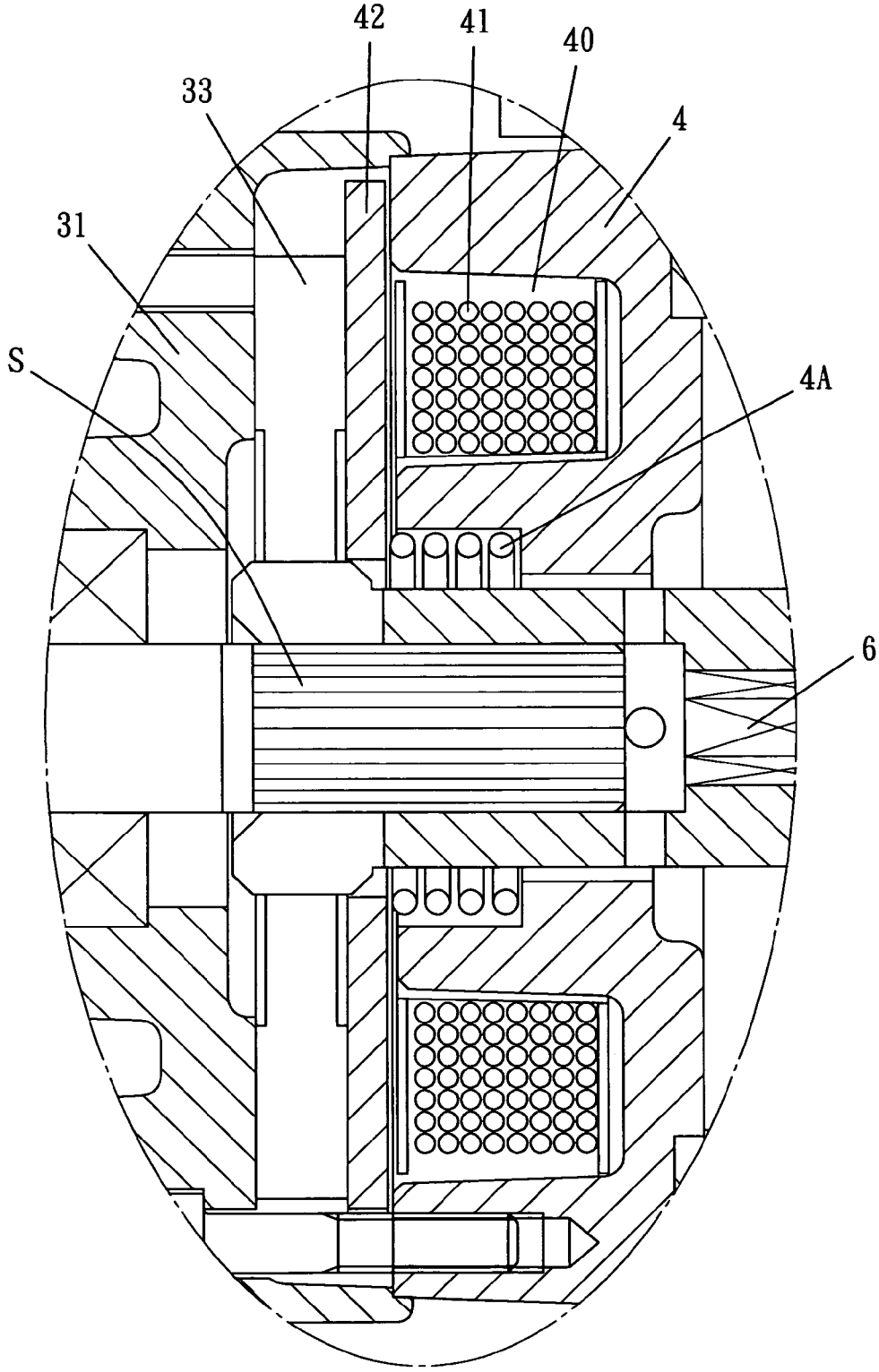
FIG. 5 is a partial magnified cross-sectional view of the induction coil producing no magnetic force (enabling the braking lining to perform braking) in the present invention.

Referring to FIG. 5, when the power winch is electrically disconnected (by pressing a stop key or due to abrupt power outage), the motor 3 will be stopped operating and the induction coil 41 will fail to produce magnetic force. At this time, the magnetic conduction member 42 will be free from the magnetic attraction of the induction coil 41 and will be actuated by the recovering elastic force of the elastic member (4A) to move toward the braking lining 33 and push the braking lining 33 to move toward the motor holder 31, thus leaving no gap between the braking lining 33 and the magnetic conduction member 42 as well as the motor holder 31. Therefore, the braking lining 33, having its opposite sides respectively compressed by the magnetic conduction member 42 and the motor holder 31 and unable to be moved, will produce braking function, instantly forcing the rotating shaft (S) of the motor 3 and the spindle (S1) to stop rotating and also stop inertial driving to the follow-up components, such as the clutch base 25 and the like. Simultaneously, the braking lining 26 of the first braking device in the reduction box 2 is pushed by the first and the second engraved block 23, 24 to carry out principal braking. Thus, with cooperation of the first and the second braking device, the rope drum 5 can be completely stopped operating.

As can be understood from the above description, this invention has the following advantages.

1. This invention is provided with the principal braking device positioned in the reduction device 2 and the auxiliary braking device positioned at the force output portion of the rotating shaft (S) of the motor 3, having excellent effect on braking the whole power winch.

2. The second (or auxiliary) braking device can function to quickly stop the rotating shaft (S) of the motor 3 from rotating to shorten the gliding distance of braking when the power winch carrying a light load is braked, greatly lowering the probability of accidents.

While the preferred embodiment of the invention has been described above, it will be recognized and understood that various modifications may be made therein and the appended claims are intended to cover all such modifications that may fall within the spirit and scope of the invention.

I claim:

1. A dual braking device for a power winch, said device comprising a first braking device installed in a reduction box and a second braking device disposed at a force output portion of the rotating shaft of a motor, said first braking device carrying out principal braking while said second braking device functioning to quickly stop said rotating shaft of said motor, said rotating shaft of said motor inserted through a motor holder, said motor holder firmly connected with a combining base positioned at the outer side of a rope drum holder, said rotating shaft of said motor mounted thereon with a transmitting sleeve, said transmitting sleeve fitted thereon with a braking lining received in said motor holder, an electromagnetic induction coil received in the interior of said combining base and a magnetic conduction member positioned between said braking lining and said electromagnetic induction coil, said magnetic conduction member pushed by an elastic member in said combining base to move and contact with said braking lining, said magnetic conduction member moved away from said braking lining when it is magnetically attracted by said electromagnetic induction coil, said rotating shaft of said motor having its outer end secured with a spindle, said spindle inserted into said reduction device to actuate the follow-up components in said reduction box to rotate, said electromagnetic induction coil producing magnetic force to attract said magnetic conduction member to move inward and compress said elastic member when the power winch makes electrical connection for retracting or releasing steel ropes, a gap formed between said braking lining and said magnetic conduction member as well as said motor holder, said braking lining unable to perform braking even though said braking lining is rotated together with said rotating shaft and said transmitting sleeve, said induction coil unable to produce magnetic force when said power winch is electrically disconnected, said magnetic conduction member actuated by the recovering elastic force of said elastic member to move away from said electromagnetic induction coil and contact with said braking lining so that no gap is formed between said braking lining and said magnetic conduction member as well as said motor holder, said braking lining able to carry out braking to quickly stop both said rotating shaft of said motor and said spindle.

* * * * *